US005172715A

United States Patent [19]

Webb

[11] Patent Number: 5,172,715

[45] Date of Patent: Dec. 22, 1992

[54] COLLAPSIBLE WALKER

[76] Inventor: Lucie O. Webb, 232 Brookdale Dr., Americus, Ga. 31709

[21] Appl. No.: 840,797

[22] Filed: Feb. 24, 1992

[51] Int. Cl.[5] ..... A61H 3/00

[52] U.S. Cl. ..... 135/67; 297/5; 482/68; 280/87.05; 135/74

[58] Field of Search ..... 135/67, 65, 74, 72, 135/75; 297/5-7, DIG. 10, 416; 482/66, 68, 69; 280/87.021, 87.041, 87.05

[56] References Cited

U.S. PATENT DOCUMENTS

| | | | |
|---|---|---|---|
| 2,596,055 | 5/1952 | Thomas | 482/68 X |
| 2,660,442 | 11/1953 | Wiesner et al. | 280/87.05 X |
| 3,442,276 | 5/1969 | Edwards et al. | 135/67 |
| 4,415,198 | 11/1983 | Brearley | 297/6 |
| 4,461,471 | 7/1984 | Brastow | 135/74 X |
| 4,748,994 | 6/1988 | Schultz et al. | 297/5 X |
| 4,907,794 | 3/1990 | Rose | 482/68 |

FOREIGN PATENT DOCUMENTS

| | | | |
|---|---|---|---|
| 2076666 | 12/1981 | United Kingdom | 297/6 |

*Primary Examiner*—Richard E. Chilcot, Jr.
*Assistant Examiner*—Lan Mai
*Attorney, Agent, or Firm*—Jones, Askew & Lunsford

[57] ABSTRACT

A foldable walker having a front frame section, left and right side frame sections and a top frame section. The left and right side frame sections and the top frame section are all hingedly attached to the front frame section. The walker folds by disengaging the top section from the left and right side frame sections. The top section pivots downwardly to lie against the front frame section. The left side section pivots outwardly to lie against the front of the front frame section. The right side frame section pivots inwardly to lie against the top frame section and the rear of the front frame section.

7 Claims, 4 Drawing Sheets

COLLAPSIBLE WALKER

TECHNICAL FIELD

The present invention relates generally to a walker, and relates more specifically to a walker having hinged members that fold against each other to form a compact unit for easy carrying and storing.

BACKGROUND OF THE INVENTION

Elderly and physically disabled persons and small children often require assistance in moving about. Walkers and canes are two devices typically used to provide such assistance. Of the two, walkers provide more stability to the user. Due to the size and general structure, most walkers tend to be bulky and cumbersome to carry or store.

There are several types of walkers available today, each offering a variety of features. Some walkers have wheels or casters, some of those have brake assemblies. Some walkers also have seats. In addition, some walkers are foldable. Most foldable walkers are constructed of lightweight or cheap materials. Moreover some walkers are designed to be easily collapsible and tend to collapse unexpectedly often injuring the user and damaging the walker. Most collapsible walkers known in the art do not offer the structural integrity needed to support the user. Walkers that do provide structural integrity only partially fold and are still considerably bulky and cumbersome to carry and store in their folded positions. Walkers that have wheels and hand brake assemblies are less conducive to folding due to the increased complexity of the design and increased number of parts. For example, walkers having hand brake assemblies are difficult to include in a foldable walker because the hand brake, cable and wheel brake assemblies must remain undisturbed when the walker is folded.

There is a need for a walker that collapses and folds to a compact size that is easy to carry and store.

There is a further need for a collapsible walker having structural integrity.

SUMMARY OF THE INVENTION

As will be seen, the present invention overcomes these and other disadvantages associated with prior art walkers. Stated generally, the present invention comprises an improved collapsible walker that is capable of collapsing and folding into a compact arrangement that is easily carried and stored.

The walker is designed so that it remains structurally sound when it is in the unfolded position. Furthermore, the improved walker is designed so that it cannot unexpectedly collapse while in use.

Stated somewhat more specifically, the walker includes a front frame section having an upper member, and left and right legs. The legs extend downwardly from the upper member. A left frame section is pivotably attached to and extends rearwardly from the front frame section. Similarly, a right frame section is pivotably attached to and extends rearwardly from the front frame section. A top frame section has left and right handlebar assemblies. The handlebar assemblies are pivotably attached to the upper member of the front frame section. Each handlebar assembly has a collar capable of retractable engagement with the corresponding side frame section.

The disclosed embodiment features wheel assemblies extending from the legs of the front frame section and from the side frame sections. In addition, the disclosed embodiment has a hand brake assembly.

To assemble, the side frame sections pivot with respect to the front frame section so that the side frame sections extend rearwardly from the front frame section. The top frame section pivots and extends rearwardly with respect to the front frame section until the top frame section is substantially horizontal. A collar pivotably attached to each handlebar assembly is received into one of the side frame sections.

To collapse the walker, each handlebar assembly pivots upwardly with respect to the front frame section to disengage the collar from the side frame section. Then each handlebar assembly pivots downwardly relative to the front frame section until the handlebar assembly lies against the front frame section. One side frame section pivots inwardly to lie against the handlebar assemblies of the top frame section. The other side member pivots outwardly and around to lie against the front of the front frame section.

Thus, it is an object of the present invention to provide an improved collapsible walker capable of being folded into a compact shape for easy carrying and storage.

It is a further object of the present invention to provide a collapsible walker having structural integrity.

Other objects, features and advantages of the present invention will become apparent upon reading the following specifications, when taken in conjunction with the drawings and the appended claims.

DETAILED DESCRIPTION OF THE INVENTION

Figure 1:
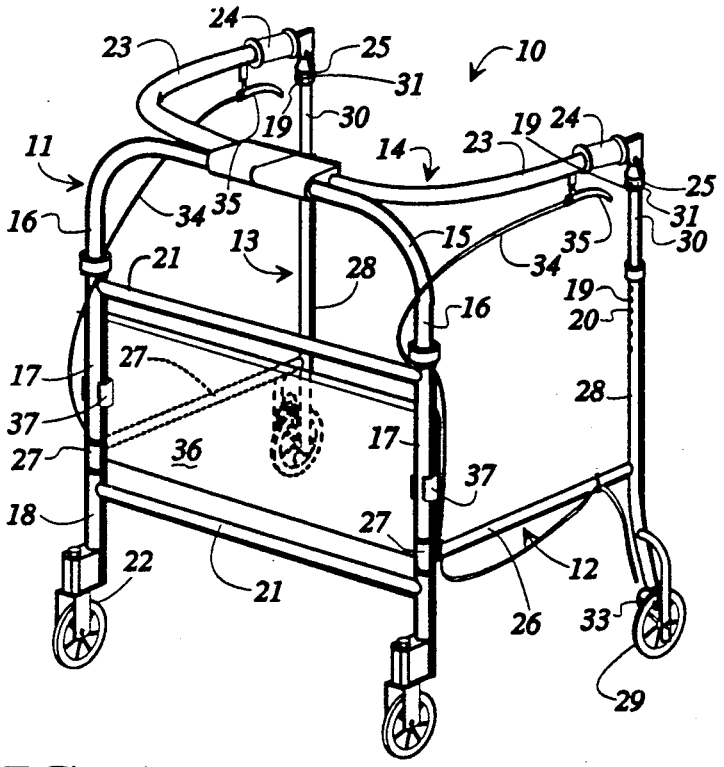
FIG. 1 is a perspective view of the walker in an unfolded, assembled position.
Figure 2:
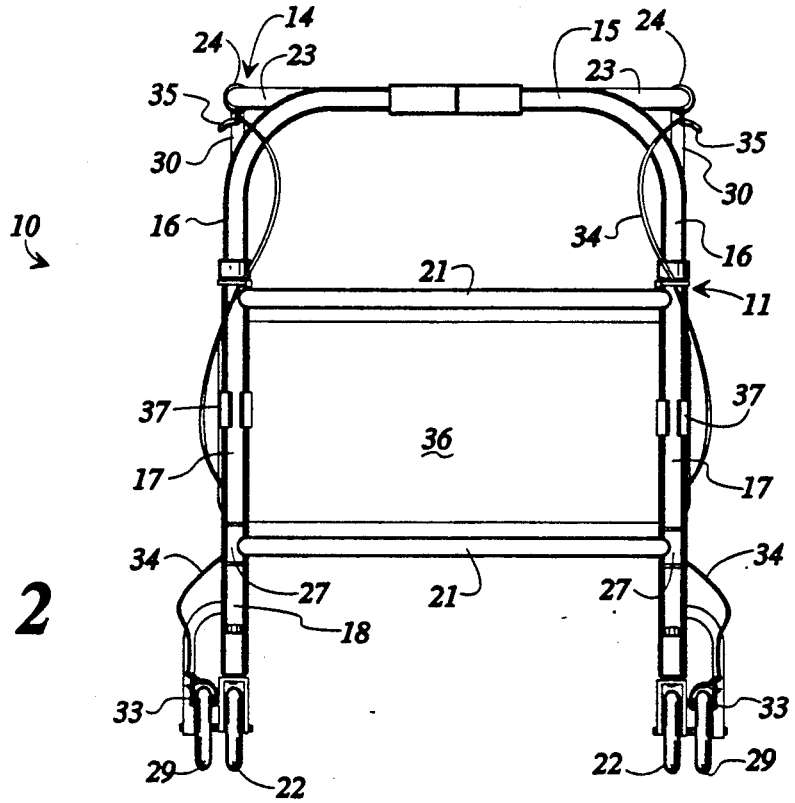
FIG. 2 is a front view of the walker of FIG. 1.
Figure 3:
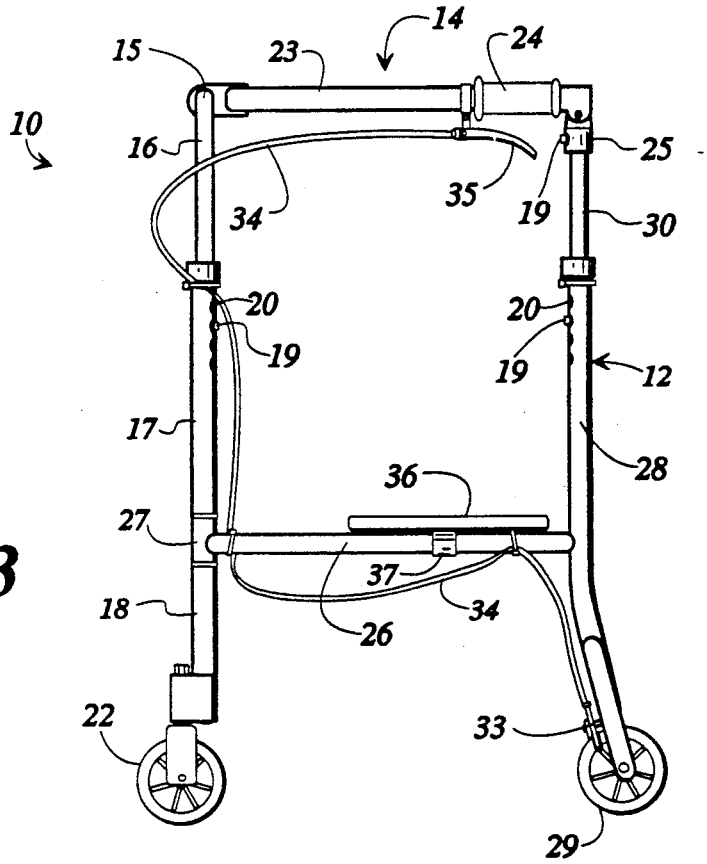
FIG. 3 is a side view of the walker of FIG. 1.
Figure 4:
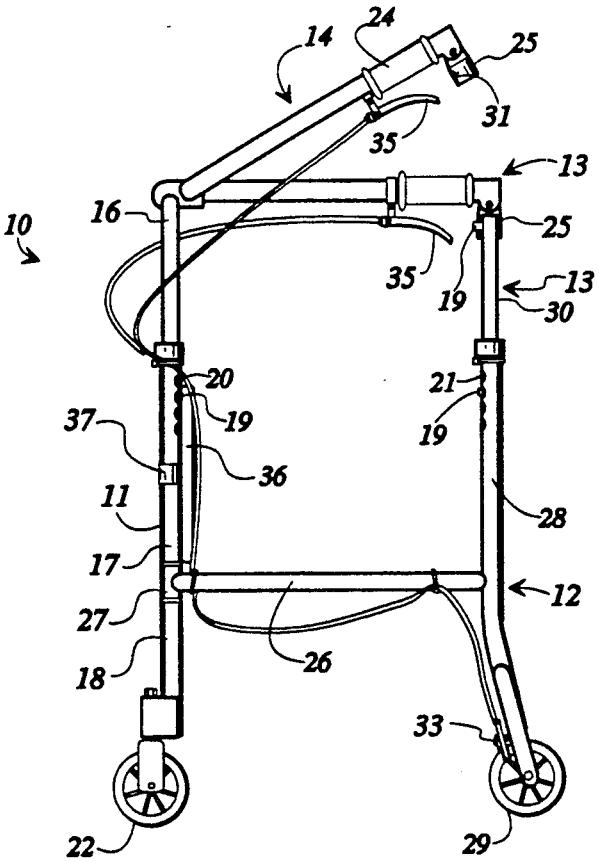
FIG. 4 is a side view of the walker of FIG. 1 in a partially folded configuration.

Referring now to the drawings, in which like numerals indicate like elements throughout the several views, FIGS. 1–7 disclose a walker 10 in accordance with the present invention. The walker 10 includes a front frame section 11, a left frame section 12, a right frame section 13, and a top frame section 14. The front frame member 11 includes a u-shaped upper front frame member 15 having downwardly depending arms 16. The arms 16 are received into sleeves 17 of a lower front frame member 18. Each arm 16 has a rearwardly extending spring loaded pin 19. Each sleeve 17 has a series of rearwardly-facing vertically aligned openings 20. The pins 19 are depressed as the arms 16 are received into the sleeves 17 as shown in FIGS. 3 and 4. The height of the front frame section 11 is adjusted by selectively positioning the pins 19 on the arms 16 with a particular opening 20 on the sleeves 17.

The front frame section has cross members 21 shown in FIGS. 1 and 2 for bracing purposes. In addition, caster wheel assemblies 22 are secured to the bottom end of each sleeve 17.

Referring further to FIG. 1, the top frame section 14 is u-shaped and has rearwardly extending handles 23. Each handle 23 is pivotably attached to the upper front frame section 15. Hand grips 24 are adjacent to the rearmost ends of the handles 23. A collar 25 is pivotably attached to the end of each handle 23 for reasons described below.

Referring now to FIG. 3, the left and right frame sections 12, 13 each have a horizontal arm 26 which is pivotably attached by means of a pivot joint 27 to one of the sleeves 17 of the front frame section 11. A vertical tube 28 is attached to the end of the horizontal arm 26. A rod 30 is telescopically received into the upper end of each tube 28. A spring-loaded pin mounted on the rod 30 engages a selected one of a series of corresponding holes 20 in the tube 28 to adjust the height of the rod with respect to the tube. The upper end of the rod is releasably secured to the collar by a similar spring-loaded pin arrangement to join the top frame section 14 to one of the side frame sections.

A wheel assembly 29 is mounted at the lower end of each tube 28. Each wheel assembly 29 has a conventional hand brake assembly 32. The hand brake assembly 32 includes brake pads 33, cable 34, and a hand brake lever 35. The hand brake lever is secured to the handle 23. If desired, a locking mechanism for the brake assembly may be provided so that the user does not need to maintain constant compression to the hand brake assembly to keep the wheels from rotating.

A seat 36 is removably secured to the front frame section 11 by means of resilient clips 37 as shown in FIGS. 1 and 2. The clips 37 are fastened to the bottom surface of the seat 36. In its stored position, the clips 37 attach to the sleeves 17 of the front frame section 11. In its operable position the clips 37 attach to the horizontal arms 26 of the left and right frame sections 12, 13, shown in FIGS. 3 and 4.

To assemble the walker 10, the pins 19 in the arms 16 of the front frame section 11 are depressed and selectively positioned within one of the openings 20 in the sleeves 17. Thus, the desired height of the front frame section 11 is obtained. Similarly, the top frame section is adjusted by depressing the pins 19 on the lower end of the rods 30 of both the left and right frame sections. Then the pins 19 are selectively positioned within a particular opening 20 on the vertical tubes 28. The left and right side frame sections 12, 13 pivot with respect to the front frame section 11 until the side frame sections extend rearwardly. The handles 23 of the top frame section 14 pivot upwardly with respect to the front frame section 11 until the handles are substantially horizontal. The collar 25 at the end of each handle 23 is positioned downwardly. The opening 31 in the collar 25 engages the pin 19 on the upper end of the inner rod 30 to secure the top frame section to the left and right frame sections 12, 13, as shown in FIG. 4.

To use the walker, the height of the front frame section 11 is adjusted so as to meet the hip or waist height of the user. The height of the top frame section 14 should be adjusted so that the handles 23 when attached to the side frame sections are relatively horizontal. If the user desires to walk, the seat 36 should be in its vertical position with the clips 37 attached to the sleeves 17. With his or her hands, the user grasps the hand grips 24 and steps forward. The forward motion causes the wheels to rotate and move the walker forward. If the user is unwilling or unable to stop his or her forward motion, the user may grip the hand brake levers to stop the rear wheel rotation and hence stop the forward motion of the walker. The user may also operate the walker from a sitting position by placing the seat 36 in a horizontal position securing the clips 37 to the horizontal arms 26. Sitting in the seat 36 the user moves the walker with his or her feet.

Figure 5:
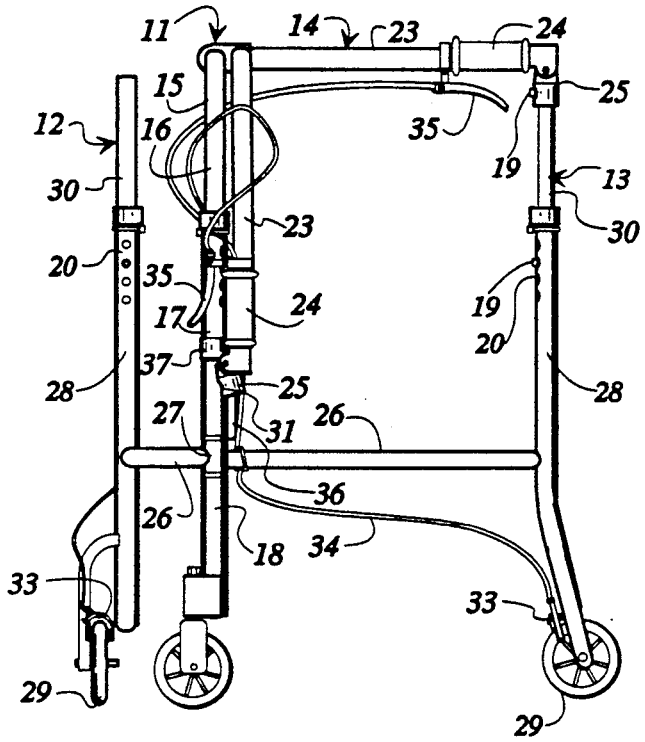
FIG. 5 is a side view of the walker in a partially folded configuration.
Figure 6:
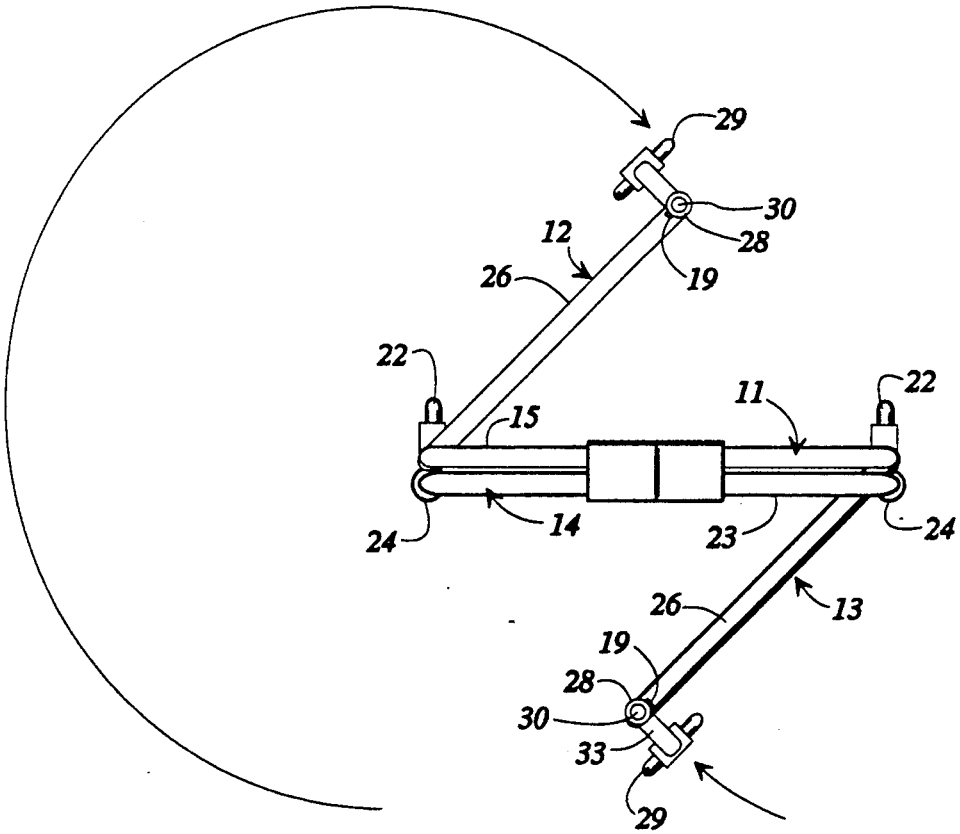
FIG. 6 is a plan view of the walker of FIG. 5.
Figure 7:
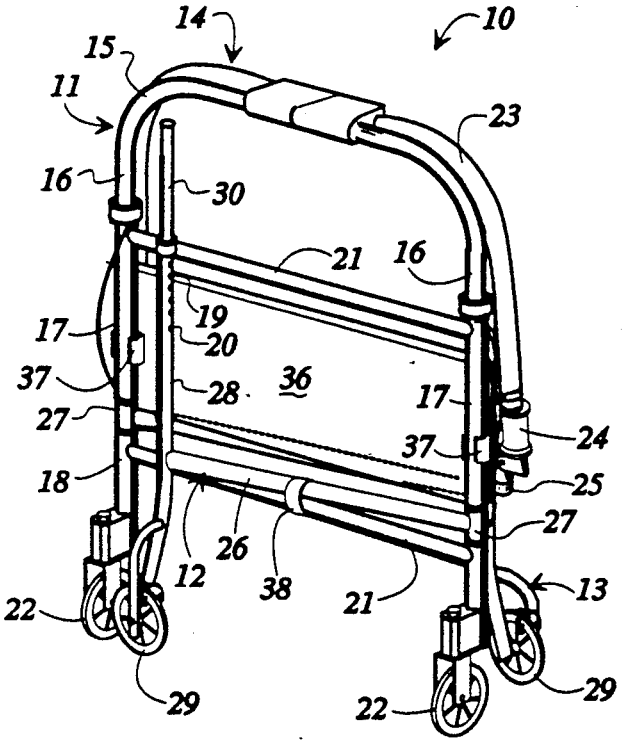
FIG. 7 is a perspective view of the walker in a fully folded, collapsed position.

Returning to FIG. 1, the walker 10 is folded by first placing the seat 36 in its vertical position with the clips 37 attached to the sleeves 17. The pin 19 on the collar 25 of the left frame section 12 is depressed. The handle 23 above the left frame section pivots upwardly as shown in FIG. 4 causing the collar 25 to disengage from the rod 30 of the left frame section. The handle 23 above the left frame section 12 then pivots downwardly so that it is flush against the front frame section 11, as depicted in FIG. 5. The left frame section 12 pivots outwardly about the pivot joint 28 and to rest against the front of the front frame section 11. The left frame section 12 is held secure to the front frame section 11 by a length of self adhering material 38 such as Velcro as shown in FIG. 7. The length of material 38 is looped around the horizontal arm 26 of the left frame section 12 and around the cross member 21 of the front frame section 11.

To fold the other side of the walker 10, the pin 19 on the rod 30 of the right frame section 13 is depressed. The handle 23 above the right frame section 13 pivots upwardly and disengages the collar 25 from the rod 30. The handle 23 above the right frame section then pivots downwardly to rest against the front frame section 11. The right frame section 13 pivots inwardly about the pivot joint 28 to rest against the top frame section 14 and the rear of the front frame section 11. A view of the directions in which side frame sections pivot is provided in FIG. 6. The walker in its folded position as shown in FIG. 7, is ready to be carried or stored. While the disclosed method of folding the walker 10 shows the left frame section 12 folded in front of the front frame section 11 and the right frame section 13 folded to the rear of the front frame section, the side frame sections 12, 13 can be folded in opposite directions with respect to the front frame section such that the right frame section is folded in front and the left frame section is folded in back of the front frame section.

Finally, it will be understood that the foregoing embodiment of a walker has been disclosed by way of example and that other modifications may occur to those skilled in the art without departing from the scope of the appended claims.

I claim:

1. A foldable walker comprising:

a front frame section having a top member, a left leg, and a right leg, said legs extending downwardly from the ends of said top member;

a left side frame section pivotably attached to said front frame section and extending rearwardly therefrom, a right side frame section pivotably attached to said front frame section extending rearwardly therefrom; and a top frame section comprising a left handlebar assembly and a right handlebar assembly, said handlebar assemblies being pivotably mounted to said top member of said front frame section, and each said handlebar assembly having a downwardly extending collar, said collar capable of retractable engagement with said corresponding side frame section.

2. The walker of claim 1 wherein said left and right handlebar assemblies are pivotably mounted to said top section so as to pivot independently of one another.

3. The walker of claim 1 wherein said legs and said left and right side frame sections have wheels extending downwardly therefrom.

4. The walker of claim 3 further comprising a braking means.

5. The walker of claim 1 further comprising a detachable seat.

6. The walker of claim 1 wherein the height of said legs is adjustable.

7. The walker of claim 1 wherein the height of said side sections is adjustable.

* * * * *